United States Patent [19]

Kawai et al.

[11] 4,080,163

[45] Mar. 21, 1978

[54] METHOD FOR PRODUCING A NON-WOVEN FABRIC

[75] Inventors: Atsushi Kawai, Hiroshima; Migaku Suzuki, Otake; Yoshinosuke Mori, Otake; Seigi Suzuki, Otake, all of Japan

[73] Assignee: Mitsubishi Rayon Co., Ltd., Tokyo, Japan

[21] Appl. No.: 684,365

[22] Filed: May 7, 1976

[30] Foreign Application Priority Data

May 8, 1975 Japan ..... 50-55728

[51] Int. Cl.[2] ..... D06M 1/00; D06M 13/28

[52] U.S. Cl. ..... 8/122; 8/115.5; 8/116 R; 162/157 C

[58] Field of Search ..... 8/122, 115.5, 116 R; 162/157 C

[56] References Cited

U.S. PATENT DOCUMENTS

| | | | |
|---|---|---|---|
| 3,718,537 | 2/1973 | Kawai et al. | 162/157 C |
| 3,832,281 | 8/1974 | Kawai et al. | 162/157 C |
| 3,901,760 | 8/1975 | Adki | 162/157 C |

FOREIGN PATENT DOCUMENTS

| | | |
|---|---|---|
| 467,257 | 1937 | United Kingdom. |

*Primary Examiner*—A. Lionel Clingman
*Attorney, Agent, or Firm*—Oblon, Fisher, Spivak, McClelland & Maier

[57] ABSTRACT

A wet formed web is overfed onto a running net by a liquid stream type web feeding apparatus so as to place the web into folded condition which is then subjected to regeneration and aftertreatments.

6 Claims, 8 Drawing Figures

METHOD FOR PRODUCING A NON-WOVEN FABRIC

BACKGROUND OF THE INVENTION

1. Field of the Invention:

The present invention relates to a method for producing a non-woven fabric. Particularly, the present invention relates to a method for producing a non-woven fabric of regenerated cellulose fibers.

2. Description of the Prior Art:

Spun-bond techniques have recently been introduced in the field of polyolefin, polyamide, and polyester fibers which combined the step of melt spinning and the step of web formation. In this technique, the fibers obtained by the melt spinning are directly formed into a web and then the web is subjected to a heat pressing treatment to produce a self-coherent fibrous sheet material. Since aftertreatments, such as washing and bleaching of the web, are usually unnecessary in this technique, the steps subsequent to the web formation are comparably simple so that the fibrous sheet materials can be easily produced at a high rate of productivity.

On the other hand, a method described as a wet spun-bond technique is able to produce fibrous sheet materials by the step of web formation in succession to the wet spinning of the fiber. This method is applicable to viscose, cuprammonium rayon, or acrylonitrile fibers.

One of the problems in the wet spun-bond technique is the necessity to perform regeneration, and after treatments such as treatment(s) for completion of regeneration, desulfurization, and bleaching of the web in the case of viscose fibers and washing of the web to wash off the remaining solvent in the case of acrylonitrile fibers, and thus the space to be occupied by the apparatus for the aftertreatments becomes so large that problems occur in improving productivity per unit area occupied by the apparatus. Moreover, as a change in the size of the web will be caused by regeneration, washing, and the like treatments, close attention is required in the control of tension applied to the web. Sophisticated tension control requires expensive apparatus. Further, it is difficult to produce economically a sheet material of low weight unless the feeding speed of the web is markedly increased. As apparent, previous wet spun-bond techniques have appreciable shortcomings.

SUMMARY OF THE INVENTION

It is an object of the present invention to provide a method for producing a non-woven fabric by spinning a polymer solution to form filaments, wet forming the filaments into a web with or without the step of cutting of filaments, overfeeding the web onto a running net so as to place the web into folded condition, and then subjecting the web to regeneration and aftertreatments while maintaining the folded condition.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE PREFERRED EMBODIMENTS

Non-woven fabrics of the present invention are composed of cellulose fibers which are regenerated from hydroxymethyl cellulose xanthate containing fibers, cellulose xanthate containing fibers, or incompletely regenerated cuprammonium rayon fibers, acrylonitrile fibers, polymethaphenylene isophthalamide fibers or other synthetic fibers which can be obtained from a solution of fiber-forming polymer.

The present invention will be first explained below in detail with regard to hydroxymethyl cellulose xanthate containing fibers.

Hydroxymethyl cellulose xanthate fibers are continuously formed into a web according to the method as disclosed in U.S. Pat. No. 3,832,281. The resultant wet web which has heat fusing ability is then subjected to a partial heating and pressing treatment to fuse the hydroxymethyl cellulose xanthate and simultaneously to decompose it into cellulose, whereby the web is set into stable condition. The thus set web is overfed onto a running net so as to place the web into folded condition.

Figure 1:
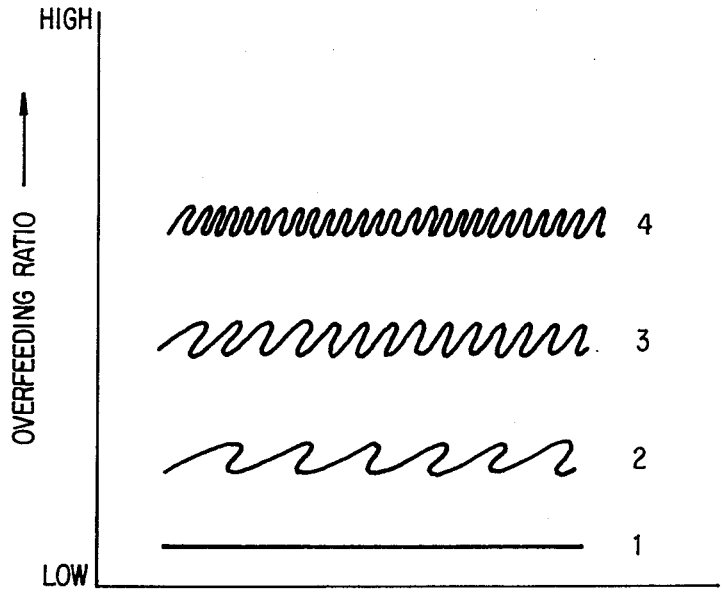
FIG. 1 is a model drawing which correlates the overfeeding ratio with the extent of folding of the web in the present invention.
Figure 2:
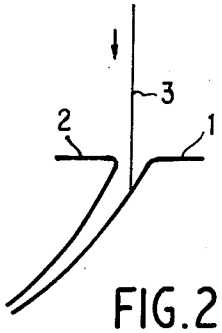
FIGS. 2–5 illustrate a side view of a liquid stream type web feeding apparatus used in the present invention.
Figure 3:
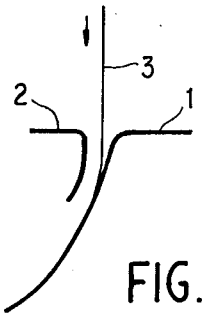
Figure 4:
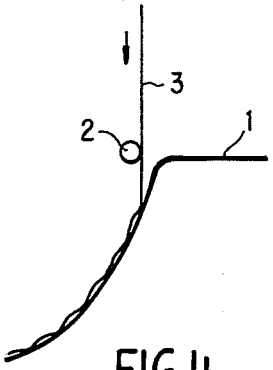
Figure 5:
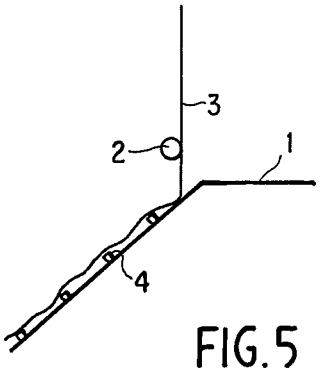

The term "folded condition" used in the present invention refers to an accordion structure, such as the structures illustrated as items 2,3 and 4 in FIG. 1, which are formed by overfeeding a flat web, such as the web 1 in FIG. 1, at an overfeeding ratio which is more excessive than the overfeeding ratio required to counter-balance the amount of shrinkage of the web.

The overfeeding ratio is a speed ratio expressed as the ratio

In order to produce a non-woven fabric of even characteristics, it is necessary to place the web into a uniform folded condition. Therefore, in the present invention a web feeding apparatus employing a liquid stream is most preferably used, although the conventional method wherein a swing roll is used to fold a cloth can be adopted as a web feeding apparatus.

Various web feeding apparatus preferably used in the present invention are illustrated in FIGS. 2 through 5, wherein 1 is a lower plate, 2 is an upper plate or a bar, 3 is a web, and 4 is a step-like bar.

Figure 6:
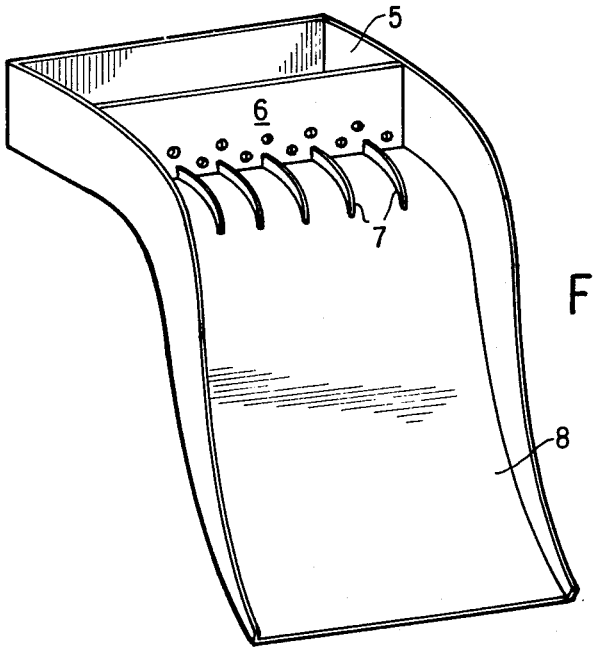
FIGS. 6 and 7 show embodiments of the liquid stream type web feeding apparatus.
Figure 7:
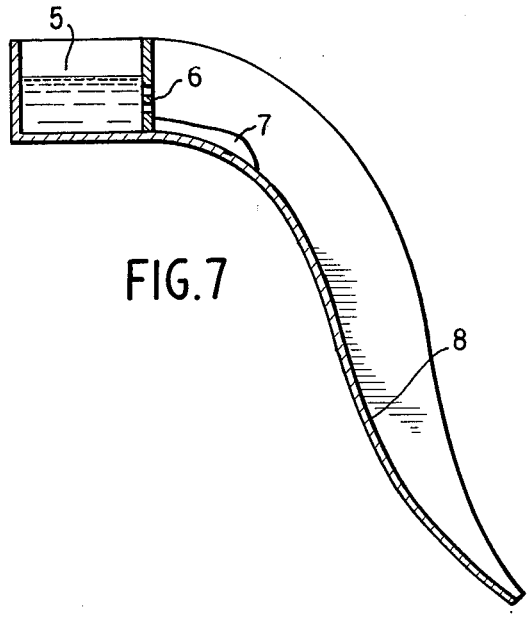

All of these web feeding apparatuses are composed of, as shown in FIGS. 6 and 7, liquid feeding portion 5, stream rectifying portion 6, channel 7, and thin layer liquid stream path 8.

A folded condition is obtained when a web is overfed into a running net owing to the difference in speed between the liquid stream and the running net, and attention must be paid to the following points to form uniform folded condition;

(i) Uniform liquid stream state should be produced. For example, liquid feeding portion 5 in FIGS. 6 and 7 is for retaining the liquid supplied from an exterior source and for supplying the liquid uniformly in the widthwise direction of the web. Therefore, this liquid feeding portion 5 is required to have a capacity large enough to create sufficient head pressure in order that the liquid can be fed across the entire width of the channel. Rectifying portion 6 is for damping disturbances in the liquid stream just before the contact of the liquid with the web and to insure equal distribution of the liquid across the channel. Thin layer stream path 8 is for transferring the web to the net, together with the liquid, as smoothly as possible, and the degree of uniformity of the folded condition depends on the uniformity of the transfer.

(ii) A suitable relation between liquid stream speed and web feed speed should be provided. The speed of liquid stream must be kept higher than the web feeding speed, and preferably within the range of $V_2/V_1 = 1.5$ to 30.0 (wherein $V_1$ is the feed speed of the web and $V_2$ is the feed speed of the liquid stream).

(iii) The feeding liquid and web should rapidly be separated. In order to attain a uniform folded condition of the web, it is important to separate the web falling on the net from the liquid as rapidly as possible. That is, removal of the liquid must be uniformly and rapidly carried out. For this purpose, the mesh of the net is preferably relatively coarse and usually is 30 mesh to 5 mesh. When a net of finer mesh is used, a vacuum box should desirably be provided below a portion of the net on which the liquid stream and the web fall.

(iv) The web used should have low rigidity. It is necessary for forming a fine and uniformly folded condition that the web itself be soft. Use of a web which has a low weight, and which is composed of fibers of fine denier and low rigidity is advantageous. Therefore, it may be effective to use a feed liquid which has the ability to slightly swell the fibers of the web, and to use a heated feed liquid so that the rigidity of the web is lowered.

If the folded condition is not uniform, unevenness of the aftertreatments will occur.

Figure 8:
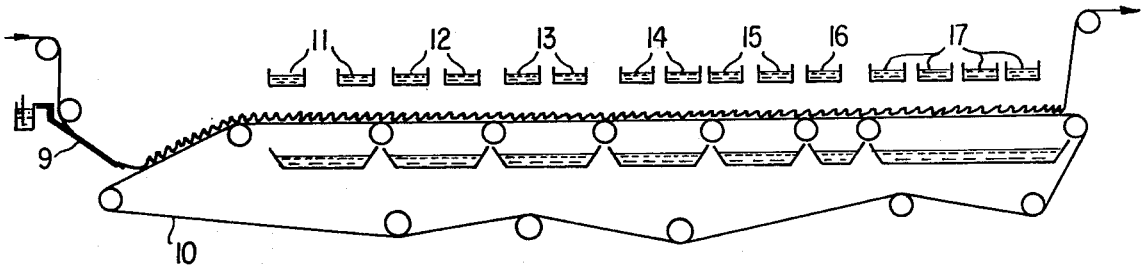
FIG. 8 illustrates a suitable apparatus for attaining the present invention.

The web which is placed into a folded condition on the net is then subjected to regeneration treatment(s) and, various aftertreatments. FIG. 8 illustrates a suitable process for treating the web composed of hydroxymethyl cellulose xanthate containing fibers, wherein various treating liquids are distributed onto the web. In FIG. 8, 11 is a weakly acidic aqueous solution at 50°–80° C and is designated as the first regenerating bath. The web in a folded condition is treated with the first regenerating bath to decompose a part of the hydroxymethyl cellulose xanthate in the fibers into cellulose, wherein a number of crimps of the fiber are developed, which crimps impart a good hand to the non-woven favric to be obtained.

Water or the same liquid as the first regenerating bath may be used as the liquid for feeding the web onto the net. Element 12 is an aqueous acidic solution at 70° – 90° C which is described as the second regenerating bath and is for decomposing the remaining hydroxymethyl cellulose xanthate completely into cellolose. Element 13 is a water bath for washing the web, 14 is for heat alkali treatment, 15 is an aqueous sodium hypochlorite solution for bleaching the web, 16 is for neutralization, and 17 is a water bath. Element 9 is a liquid stream type web feeding apparatus such as shown in FIGS. 6 and 7 and element 10 is the running net.

Since these regeneration treatments and aftertreatments must be performed for substantial periods of time, an apparatus requiring considerable space is necesary when the web is not treated in a folded condition. However, when the web is treated in a folded condition according to the present invention, it is possible to employ compact apparatus yet permit the web to receive all necessary treatments. For instance, when the overfeeding ratio of 30 is used, it is possible to treat the web with a treating capacity per unit space of nearly 30 times as much as that when the folding is not performed.

As another advantage, when the web is treated in a folded condition, tension will not be applied to the web during the aftertreatments and a non-woven fabric which has a good hand can be obtained.

According to the present invention, pressing rolls or suction devices to dehydrate the web may be provided just after each such treatment to make the aftertreatments more effective.

In the present invention, as high an overfeeding ratio as possible is preferable as long as a relatively dense uniform folded condition is attained. Usually, the correlation is such that a higher overfeeding ratio can be employed with an increase in the softness of the web, and when a non-woven fabric of a weight of about 20 $g/m^2$ is to be produced, a perferable overfeeding ratio is usually in the range of 20 – 70. In the case of a weight of about 100 $g/m^2$, the overfeeding ratio is preferably in the range of 3 to 20.

It is noted that it is possible to pass the web through an aftertreatment step in the folded condition, then straightening the web and dehydrating the web by pressing rolls or a suction device, and then placing the web back into folded condition again for a subsequent aftertreatment. In the case of a web composed of hydroxymethyl cellulose xanthate containing fibers, in order to obtain a bulky non-woven fabric by fully developing the shrinkability of the fibers, the web can initially be subjected to bulking treatment in a folded condition, unfolded from the folded condition, subjected to regeneration treatment, overfed onto a net to place the web into folded condition again, and then subjected to additional treatments such as completion of regeneration, refining, and bleaching, all as disclosed in the specification of U.S. patent application No. 619,309 filed on Oct. 3, 1975.

Next, the present invention will be explained with regard to a web of cellulose xanthate containing fibers.

The web is obtained by spinning a viscose into an acidic spinning bath to form filaments, cutting the filaments into short length, dispersing the cut fibers in water, and then forming the fibers into a wet web. Alternatively, the web may be obtained by spreading the filaments without cutting. The wet web is made into stable condition (set condition) by pressing a part or all of the surface of the web with a roll to cause self-bonding of the fibers. The web is pressed as it is when the web has a high degree of swelling, or after treatment with a spray of a weakly basic aqueous solution when the web does not have a high degree of swelling. Other methods may be used for making the web into stable condition where the fibers of the web are mechanically entangled with fluid jet streams.

The web in stable condition is overfed onto a net so as to place the web into folded condition as in the case of hydroxymethyl cellulose xanthate containing fibers. The liquid stream type web feeding apparatus is most preferably used for feeding the web, and the structure of the apparatus and the feeding method are much the same as in the previously discussed case of hydroxymethyl cellulose xanthate containing fibers. As liquid for the feeding apparatus, water or aqueous acidic solution at 30° to 90° C may be used. The swollen web, after it is subjected to the pressing, is suitable for arrangement into a uniform folded condition.

The folded web on the net is subjected to various treatments while maintaining the folded condition by using much the same apparatus as shown in FIG. 8. In the treatments, the web is first treated with an aqueous acidic solution at 40° to 90° C to decompose cellulose xanthate into cellulose, and then subjected to washing with water, hot alkali treatment, bleaching with sodium hypochlorite, neutralization, and washing with water.

Overfeeding ratio is varied with the weight of the web and the denier of fibers in the web, but is preferably 3 to 70, most desirably 5 to 60. As before, when treated in the folded state, minimization of the size of the aftertreatment apparatus is possible and marked improvement in productivity of the non-woven fabric is attained.

An embodiment of the present invention where incompletely regenerated cuprammonium rayon is used is explained below.

A highly swollen web composed of incompletely regenerated cuprammonium rayon filaments or fibers is subjected to pressing to cause the self-bonding of the filaments or fibers or alternatively may be treated with liquid jet streams to mechanically entangle the filaments or fibers, whereby the web is made into a stable configuration. This web is overfed onto a net so as to place the web into a folded condition in a manner as described above. As liquid for the feeding apparatus, water or dilute aqueous sulfuric acid solution is suitable. The web in the folded condition on the net is subjected to a regeneration treatment and aftertreatments while maintaining the folded condition by using much the same apparatus as shown in FIG. 8. In these treatments, the web is first treated with about 5% aqueous sulfuric acid solution and then throughly washed with water to complete regeneration and washing.

In the case of acrylonitrile fibers, wet- or dry-spun filaments containing remaining solvent are formed into a web as they are, or after being subjected to a cutting step.

The web is made into stable condition by heat pressing or liquid jet stream treatment to entangle the filaments or fibers, then overfed onto a net so as to place the web into a folded condition. As liquid for the feeding apparatus, water at a high temperature is suitable. The web in folded condition on the net is washed with water at a high temperature.

The present invention can be applied to any spunbond technique where various aftertreatments are necessary after the web formation. Aftertreatments of the web may be performed by applying a shower of the treating liquids on the web or immersing the web in the treating liquid while maintaining the web on the net in folded condition. In some cases, the web can be treated with steam in the folded condition. For example, in the case of a web of acrylonitrile fibers, the web in folded condition can be washed with water to wash off the remaining solvent and then subjected to a continuous steam relaxing treatment.

Having generally described the invention, a more complete understanding can be obtained by reference to the following specific example, which is included for purpose of illustration only and is not intended to be limiting unless otherwise specified.

EXAMPLE 1

A viscose containing 7.8% cellulose having a polymerization degree of 390 and 4.2% total alkali, and having a salt point of 20 and a viscosity of 210 poises was extruded into a spinning bath containing 33 g/l of sulfuric acid, 65 g/l of sodium sulfate, and 12 g/l of formaldehyde at 25° C. The filaments withdrawn from the spinning bath were stretched 100% in an aqueous acidic bath containing 20 g/l of sulfuric acid at 70° C to produce a stretched filament tow. The filaments had a monofilament denier of 2. The stretched tow was continuously cut to 15 mm length with a cutter and immediately dispersed in water. The dispersed cut fibers were formed into a web by a paper making machine of the inclined short net type. The weight of the web was 15 g/m$^2$ and the speed of the paper making was 100 m/min. After the web was dehydrated, it was pressed with an embossing roll having heated projections to partially fuse the web, whereby the web was made into a stable condition. Surface temperature of the embossing roll was 120° C and the pressure was 4.0 Kg/cm$^2$. This web was subjected to regeneration treatments and aftertreatments according to the process as shown in FIG. 8. More specifically, the web was overfed onto a running net 10 at a overfeeding ratio of 50 so as to place the web into a folded condition by a liquid stream type web feeding apparatus 9. As liquid for the feeding apparatus, water at ambient temperature was used. The web was placed into a folded condition of a regular and uniform accordion like structure. The web supplying speed to the feeding apparatus was 100 m/min and the net running speed was 2 m/min. The folded web on the net was treated with a shower from the first regenerating bath 11 of an aqueous solution containing 1 g/l of sulfuric acid at 65° C, treated with a shower from the second regenerating bath 12 of an aqueous solution containing 1 g/l, of sulfuric acid at 85° C, washed with water at 13 at 60° C, treated with aqueous solution at 14 containing 5 g/l of sodium hydroxide at 80° C, treated with a shower of aqueous basic solution 15 containing sodium hypochlorite (effective chlorine concentration is 0.5 g/l), neutralized with dilute aqueous sulfuric acid solution bath at 16, and then washed with water at 17. After each step of the treatment, the web was dehydrated with pressing rolls while maintaining the folded condition. After these aftertreatments, the web was unfolded, dried by a Yankee type drier, and wound up on a roll to obtain a non-woven fabric which is the final product. The non-woven fabric did not have any crease, had a beautiful appearance, and showed a soft and comfortable hand. The non-woven fabric also had the following characteristics:

| | |
|---|---|
| Weight | 20.3 g/ m$^2$ |
| KGSC strength | |
| (machine direction) | 178 Kg/cm/ /g/cm$^2$ |
| (transverse direction) | 106 Kg/cm/ /g/cm$^2$ |
| Elongation | |
| (machine direction) | 16% |
| (transverse direction) | 23% |
| Remaining sulfur | 0.04% |
| Remaining formaldehyde | not detected |
| Whiteness | 93% |

EXAMPLE 2

A viscose containing 7.8% cellulose having a polymerization degree of 390 and 4.2% total alkali, and having a salt point of 18 and a viscosity of 220 poises was extruded into a spinning bath containing 18 g/l of sulfuric acid, 0.5 g/l of zinc sulfate, and 65 g/l of sodium sulfate at 25° C. The filaments withdrawn from the spinning bath were stretched 100% in an aqueous acid bath containing 20 g/l of sulfuric acid at 70° C to produce a stretched filament tow. The filament had a monofilament denier of 2. The stretched tow was then cut to 20 mm length, dispersed in water (the cut fiber had a primary swelling degree of 870% at this moment), and formed into a web by a paper making machine of inclined short net type. Weight of the web was 12 g/m$^2$ and paper making speed was 120 m/min. The wet solution web thus obtained had a process swelling degree of 870%. The swollen web was pressed with a pair of rolls to cause self-bonding of the fibers, whereby the web was made into a stable condition. This web was then overfed onto the running net at a overfeeding ratio of 60 so as to place the web into a folded condition using the same feeding apparatus as in Example 1. As liquid for the feeding apparatus, an aqueous solution containing 5 g/l of sulfuric acid at 80° C was used. The web was placed into a folded condition with a regular and uniform accordion-like structure. The web supplying speed to the feeding apparatus was 120 m/min and the running net speed was 2 m/min. The web in folded condition on the net was treated with a shower of an aqueous solution containing 5 g/l of sulfuric acid at 80° C to decompose the cellulose xanthate into cellulose. After washing with water, the web was treated with a shower of aqueous sodium hydroxide solution at 60° C., treated with a shower of aqueous sodium hypochlorite solution (effective chlorine concentration of 0.5 g/l), neutralized, and then washed with water. Neutralization and washing were also performed with a shower of each treating liquid. After each aftertreatment step, the web was dehydrated with pressing rolls while still in the folded condition. Subsequent to the aftertreatments, the web was unfolded, dried by a Yankee type drier, and then wound on a roll to obtain a non-woven fabric. The non-woven fabric had no crease, showed beautiful appearance, and had the following characteristics:

| | |
|---|---|
| Weight | 15.2 g/m$^2$ |
| KGSC strength | |
| (machine direction) | 112 Kg/cm/ /g/cm$^2$ |
| (transverse direction) | 94 Kg/cm/ /g/cm$^2$ |
| Elongation | |
| (machine direction) | 13% |
| (transverse direction) | 19% |
| Remaining sulfur | 0.035% |
| Whiteness | 93.5% |

Note:

(i) Method for measuring process swelling degree:

About 1.0 g of cellulose of the wet web was sampled, immediately dehydrated by a centrifugal hydroextractor at 1000G for 3 minutes, and then weighed ($W_1$). The dehydrated web was further dried at 105° C for 4 hours and then weighed ($W_2$). The process swelling degree was calculated from the following equation:

$$\text{Process swelling degree (\%)} = \frac{W_1 - W_2}{W_2} \times 100.$$

(ii) Method for measuring primary swelling degree:

About 1.0 g of cellulose of the stretched filament was sampled, immediately dipped in distilled water at 20° C for 5 hours, dehydrated at 1000G for 3 minutes, and then weighed ($W_1$). The dehydrated sample was further dried at 105° C for 4 hours and then weighed ($W_2$). The primary swelling degree was calculated from the following equation:

$$\text{Primary swelling degree (\%)} = \frac{W_1 - W_2}{W_2} \times 100$$

EXAMPLE 3

A viscose containing 7.8% cellulose having a polymerization degree of 350 and 4.2% of total alkali, and having a salt point of 15 and a viscosity of 100 poises was extruded into a spinning bath containing 38 g/l of sulfuric acid, 1.8 g/l of zinc sulfate, and 65 g/l of sodium sulfate at 25° C through a spinneret having 20,000 orifices of 0.06 mm diameter. The filaments withdrawn from the spinning bath were stretched 90% under the same conditions as in Example 2 to form a stretched filament tow. The filament had a monofilament denier of 2. The stretched filament tow was, without being cut, spread with a water stream to form a filament web, and the web was treated with a water jet stream to entangle the filaments, treated with 0.5% aqueous sodium carbonate solution to swell the filaments and then pressed with an embossing roll to make the web stable. The thus obtained web which was composed of incompletely regenerated filaments was overfed onto a running net at a overfeeding ratio of 15 so as to place the web into the folded condition by means of a slit, liquid stream type web feeding apparatus. The web supplying speed to the apparatus was 30 m/min and the running speed speed was 2 m/min. Liquid supplied to the feeding apparatus was the same as in Example 2. The web in a folded condition on the net was subjected to regeneration, refining, and bleaching in the same manner as in Example 2, released from the folded condition, and then dried by a drier of the hot air circulation type. The thus obtained non-woven fabric had the following characteristics:

| | |
|---|---|
| Weight | 40 g/m$^2$ |
| KGSC strength | |
| (machine direction) | 374 Kg/cm/ /g/cm$^2$ |
| (transverse direction) | 180 Kg/cm/ / g/cm$^2$ |
| Elongation | |
| (machine direction) | 16% |
| (transverse direction) | 35% |
| Remaining sulfur | 0.034% |
| Whiteness | 93% |

EXAMPLE 4

An acrylonitrile copolymer containing 93% by weight of polymerized acrylonitrile and 7% by weight of polymerized methyl acrylate, and having an intrinsic viscosity (measured in dimethyl formamide at 30° C) of 1.65 was dissolved in dimethyl formamide to make a solution containing 29.0% by weight of the copolymer. The solution was heated at 120° C and extruded into air at 180° C through 3 spinnerets each having 600 orifices of 0.15 mm diameter at a spinning speed of 300 m/min. The filaments thus formed were continuously stretched 4 times in saturated steam at 100° C to obtain stretched filament tow. The tow was spread with a water stream to form a filament web and the web was treated with a water jet stream to entangle the filaments, whereby the web was made into a preliminary stable condition, and then pressed with an embossing roll having projections heated at 230° C to make the web into a stable condition. The web was overfed at a overfeeding ratio of 20 onto a running net so as to place the web into a folded condition by a slide, liquid stream type web feeding apparatus. The web feeding speed was 60 m/min and the running speed was 3 m/min. The web was then washed with a shower of heated water at 85° C while maintaining the folded condition, had the remaining solvent washed off and dried in moist air at 145° C and 23% RH. The non-woven fabric thus obtained had the following characteristics:

| | |
|---|---|
| Weight | 60 g/m$^2$ |
| KGSC strength | |
| (machine direction) | 570 Kg/cm//g/cm$^2$ |
| (transverse direction | 208 Kg/cm//g/cm$^2$ |
| Elongation | |
| (machine direction) | 16% |
| (transverse direction) | 24% |
| Remaining solvent | 0.2% |

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method for producing a non-woven fabric, which comprises: feeding a wet formed web in a liquid stream through a liquid stream type web feeding apparatus onto a running net such that the ratio ($V_2/V_1$) of the liquid stream speed ($V_2$) to the web feeding speed ($V_1$) through said liquid stream type web feeding apparatus ranges from 1.5 to 30.0;

controlling the over feeding ratio in the range of 3 to 70, whereby the web is deposited on said running net into a continuous multiple folded condition;

subjecting the web to regeneration and to aftertreatments such as washing, treatment for completion of regeneration, desulfurization, bleaching and neutralization while maintaining the web in said folded condition.

2. The method according to claim 1, wherein said liquid stream type web feeding apparatus has a downwardly extending curved slit type guide passage for the wet formed sheet, with the slit being gradually decreased from an upper inlet portion thereof to a lower outlet portion, and the vertical distance between said outlet of said liquid stream type web feeding apparatus and said running net is smaller than 5 cm.

3. The method according to claim 1, wherein the web is composed of hydroxymethyl cellulose xanthate containing fibers.

4. The method according to claim 1, wherein the web is composed of cellulose xanthate containing fibers.

5. The method according to claim 1, wherein the web is overfed at a overfeeding ratio of 3 to 20.

6. The method according to claim 1, wherein the web is overfed at a overfeeding ratio of 20 to 70.

* * * * *